United States Patent [19]

Taguchi et al.

[11] Patent Number: 4,982,675

[45] Date of Patent: Jan. 8, 1991

[54] PROFILE STITCHER

[75] Inventors: Kazuo Taguchi, Sagamihara; Yoshiaki Honma, Tokyo, both of Japan

[73] Assignee: Juki Corporation, Tokyo, Japan

[21] Appl. No.: 289,986

[22] Filed: Dec. 22, 1988

[30] Foreign Application Priority Data

Dec. 26, 1987 [JP] Japan ..... 62-330908

[51] Int. Cl.[5] ..... D05B 21/00

[52] U.S. Cl. ..... 112/121.12; 112/103

[58] Field of Search ..... 112/121.12, 308, 309, 112/121.11, 121.15, 153, 102, 103, 148

[56] References Cited

U.S. PATENT DOCUMENTS 3,172,379 3/1965 Light ..... 112/121.12

4,008,672 2/1977 Cianciotti ..... 112/121.12

4,359,009 11/1982 Bennison ..... 112/121.12

OTHER PUBLICATIONS

AMF Autojig Model 84–19 MP Automatic Profile Stitching System Brochure (date unknown).

*Primary Examiner*—Peter Nerbun

*Attorney, Agent, or Firm*—Morgan & Finnegan

[57] ABSTRACT

A profile stitcher capable of stitching both curved or cornered portions of a stitch path with the same stitch pitch as straight portions by controlling the speed of a sewing motor or a roller motor which conducts a profiled frame combination with workpieces clamped therebetween. A photo sensor sends signals to one of the controlling motors to change motor speed when receiving light reflected from a reflective seal on the frame. This seal indicates a curved or cornered portion of a stitch line.

1 Claim, 5 Drawing Sheets

PROFILE STITCHER

BACKGROUND OF THE INVENTION

This invention relates to a profile stitcher which stitches together workpiece fabrics clamped between two profiled frames whose profile is similar to the stitch path and whose outer edges are fed by a contacting roller such that stitching through the profiled frame as a template is conducted and, more particularly, to controlling the speed of the conducting roller such that the stitch pitch through curved portions of the stitch path are kept the same as through straight portions of the stitch path.

Profile stitching is used to combine pieces of fabric when the pattern of stitch combination is applicable in mass usage. A profile stitcher is a template whereby the stitch path follows the shape laid out by the profile.

Referring FIGS. 5 through 7, one type of automatic profile stitcher is hereafter explained. The stitching path consists of both straight lines and curved lines. Two fabrics are clamped between an upper frame 1 and a lower frame 2. A groove 3 whose shape is similar to the profile of the frames 1, 2 is provided through both the upper and lower frames. A projection 4*a* projected from a throat plate 4 inserts loosely into the groove 3, and a roller 5 which is frictionaly contacted to the outer profiled edge of the frames is rotated at constant speed in association with the up-down motion of a needle. The roller rotates such that the frames 1, 2 are guided by the projection 4*a*. The needle flows through a needle entry n provided in the projection 4*a* allowing stitching along the groove 3.

FIG. 6 shows a stitch line stitched through the profiled frame shown in FIG. 5. Since the speed of the roller 5 is constant, stitch pitch at the curved portion $I_2$ is narrower than stitch pitch at the straight portion $I_1$. Thus, the stitching quality is poor. When the straight portion $I_1$ is stitched, its feed length is same as the circumference length of the roller 5. This, however, is not the case when the stitch path is a curve. Referring to FIG. 7, when the curved portion $I_2$ is stitched, radius $R_2$ of the curved stitch line is shorter than radius $R_1$ of the outer curved portion 1*a*, 2*a* of the profiled frame.

Thereby, because the outer curved portion 1*a*, 2*a* is conducted by the roller 5 and the stitch pitch length $1_1$ is expressed as $1_1=(2\pi r_1/360)\times\theta_1$; where $r_1$ denotes a radius of the roller 5 and $\theta_1$denotes the rotated angles of the roller 5 per one stitch; the stitch pitch length at the curved portion in the groove 3 is actually smaller than $1_1$.

Accordingly, the stitch pitch at the curved portion $I_2$ in FIG. 6 becomes smaller, and the stitching quality is degraded due to the imbalanced stitch-pitch.

Therefore, it is an object of the present invention to improve the stitching quality conducted by the profile stitcher.

It is a further object of the present invention to conduct profile stitching with equal stitch pitch through both curved portions and straight portions of the stitch line.

SUMMARY OF THE INVENTION

In automatic profile stitchers, the speed with which the profile travels through the stitch path is seen as a variable controlling the stitch pitch. The present invention implements a method and apparatus to control profile travel speed through two dimensional paths in order to control stitch pitch throughout the stitch path length. In this way uniform stitch pitch is maintained throughout the entire path length. According to the present invention, when the stitching line changes from straight to curved, a detection means detects this change, and based on the detected results, the controlling roller's speed is changed. Another way of controlling profile speed is to slow the main shaft motor such that constant stitch pitch is maintained through the curved portion.

BRIEF DESCRIPTION OF THE DRAWINGS

The invention will be described in greater detail below by way of reference to the following drawings, in which.

DETAILED DESCRIPTION OF THE DRAWINGS

Figure 1:
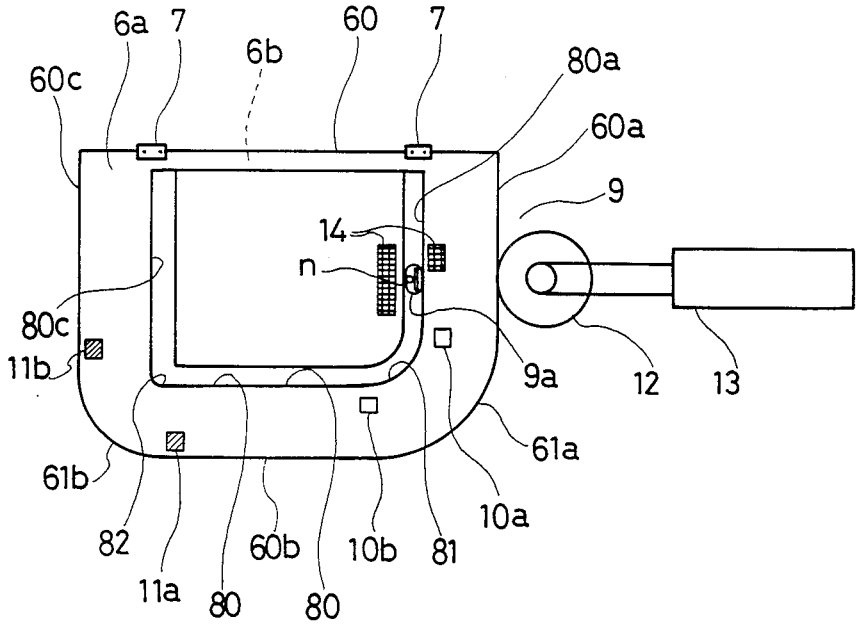
FIG. 1 is a plan view drawing according to an embodiment of the present invention.

FIGS. 1 through 4 illustrate one preferred embodiment of the present invention. Referring to FIG. 1, numerals 6*a*, 6*b* denote openable frames. These frames are adapted to open and close by a hinge 7 such that frames 6*a*, 6*b* may clamp workpieces therebetween. Edge 60 of frames 6*a*, 6*b* is profiled by straight portions 60*a*, 60*b* and by curved portions 61*a*, 61*b*. Numeral 80 denotes a groove formed in the frames 6*a*, 6*b*. The groove 80 is profiled by straight portions 80*a*, 80*b*, 80*c*, curved portion 81 and corner portion 82. These portions correspond to the respective straight and curved portions of the frame edge.

Numeral 9*a* denotes a projection from a throat plate 9 and is adapted to be loosely inserted into the groove 80. The projection 9*a* provides a needle entry n.

Numerals 10*a*, 10*b* denote reflective seals which indicate starting and ending points of the curved portion 81. The seals 10*a*, 10*b* are patched on the surface of the upper frame 6*a*. Numeral 11*a*, 11*b* denote reflective seals which indicate starting and ending points of the corner portion 82. The seals 11*a*, 11*b* are also patched on the surface of the upper frame 6*a*. Reflective seals 11*a*, 11*b* for the corner portion are located farther from the groove 80 than reflective seal 10*a*, 10*b*.

Numeral 12 denotes a roller. Roller 12 is pressed to the edge of the frame by cylinder 13. The roller 12 is rotated by a stepping motor, and numeral 14 denotes a feed dog.

Figure 2:
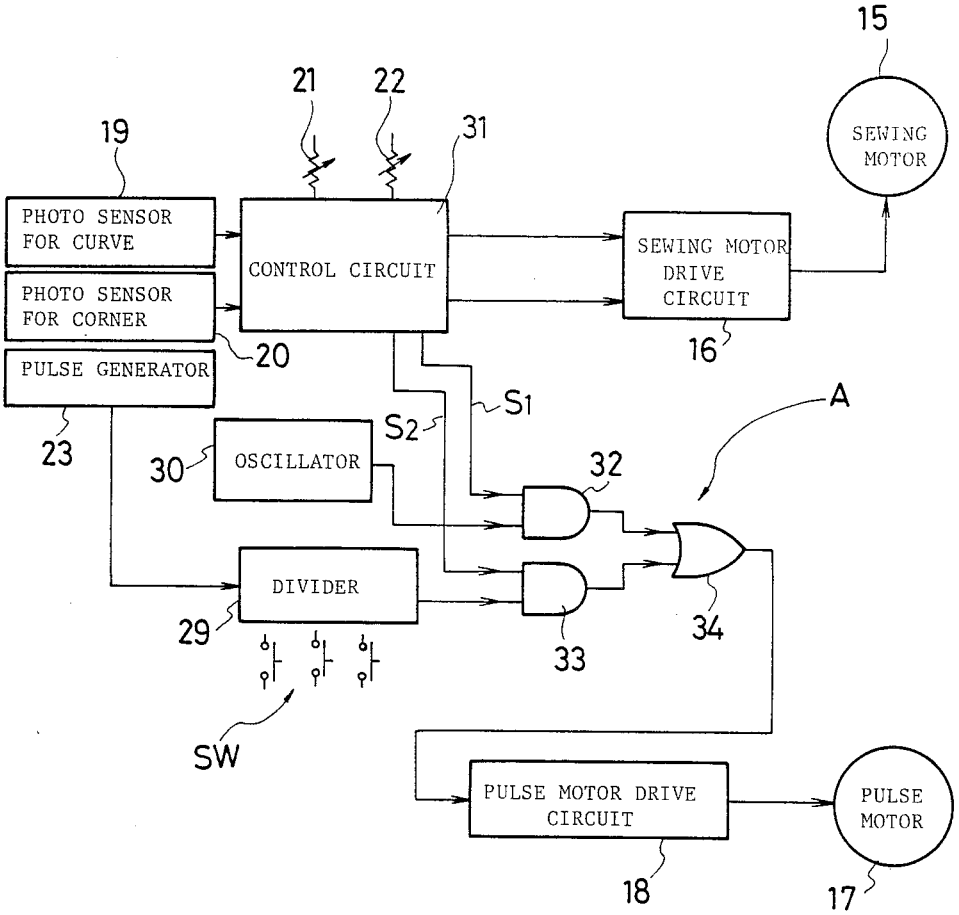
FIG. 2 is a control block diagram according to an embodiment of the present invention.
Figure 3:
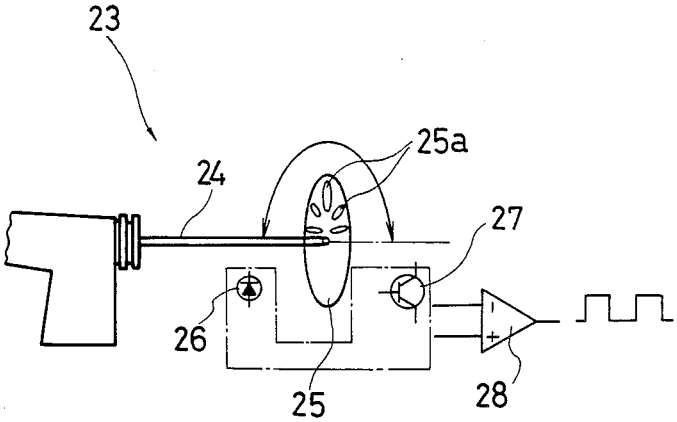
FIG. 3 is an explanatory drawing of the pulse generator shown in FIG. 2.

FIG. 2 is a control block diagram for this embodiment. In FIG. 2, numeral 15 denotes a sewing motor which causes the up-down motion of a needle and the feeding of the feed dog 14. Numeral 16 denotes a control circuit for the sewing motor 15. Numeral 17 denotes a stepping motor which drives the roller 12. Numeral 18 denotes a control circuit for the stepping motor 17, which rotates in response to a pulse; at for instance, 1.8 degrees per one pulse.

Numeral 19 denotes a photo sensor for the curved portion 81 and is located above the throat-plate 9. Photo sensor 19 detects the presence of reflective seals 10*a*, 10*b*. Numeral 20 denotes a second photo sensor for the corner portion 82 and is located above the throat plate 9. Photo sensor 20 detects the presence of reflective seals 11*a*, 11*b*. Both photo sensors 19, 20 comprise a photo-projector which projects light to the throat plate and a photo receiver which receives reflected light from the throat plate and outputs signals.

Numeral 21 denotes a variable resistor for setting the speed during a straight stitch path, and numeral 22 denotes a variable resistor for setting the speed during a curved path. In this embodiment, the resistance of variable resistor 22 for a curved path is set at the same level as the variable resistor 21 for a straight path.

Numeral 23 denotes a pulse generator which generates a predetermined pulse train associated with the motion of the needle. Pulse generator 23 is explained with reference to FIG. 3. An extended shaft 24 from the main shaft provides a disc 25 at its end. A radial slot 25*a* is equally spaced in a semi-circular portion of the disc. A light source 26 projects light to the disc 25 so the light passes through the slot 25*a* onto a photo-electric converting element 27 which outputs pulse waves. A wave shaping circuit 28 receives the pulse waves and converts them to square waves (pulse signals).

Referring again to FIG. 2, pulses from the pulse generator 23 enter a frequency divider 29 where the number of pulses are divided by divider switches SW. In this embodiment, the divider 29 is adjusted such that the pitch of the roller 12 is equal to the feed pitch of the feed dog 14.

Figure 7:
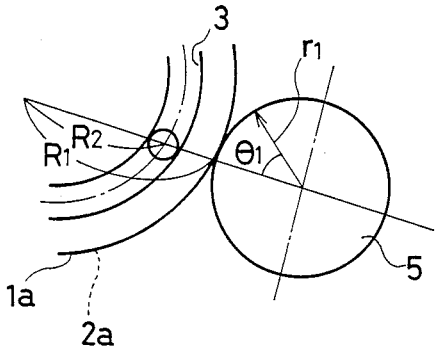
FIG. 7 (PRIOR ART)
FIG. 7 is an explanatory drawing showing how a curved stitch line is stitched according to the prior art.

Numeral 30 denotes an oscillator which outputs a constant pulse train. This pulse train from the oscillator 30 has a period $T_2$ based upon the equation $$T_2 = T_1 \times R_2 / R_1,$$

wherein $R_1$ indicates a radius at the curved portion 61*a*, $R_2$ indicates a radius at the center of the groove 80 (see FIG. 7), and $T_1$ denotes the period of the pulse train outputted from the divider 29.

Numeral 31 denotes a control circuit which controls the control circuit 16 of the sewing motor 15 in response to the output from the photo sensors 19, 20. Control circuit 16 outputs signals $S_1$, $S_2$ for switching the pulse motor drive pulse signals "L" and "H". Numeral 32 denotes an AND-gate which outputs a logical product consisting of a combination of the switching signal output from the control circuit 31 and the pulse train output from the oscillator 30. Numeral 33 denotes an AND-gate which outputs a logical product consisting of a combination of the pulse trains from the divider 29 and the control circuit 31. Numeral 34 denotes an OR-gate which outputs a logical product consisting of a combination of the outputs from the AND-gates 32 and 33. The output from OR-gate 34 is fed to the control circuit 18 for the pulse motor 17. Above described numerals 21 to 34 constitute a control means A.

In the aforementioned profile stitcher, when stitching starts, two fabrics are clamped between frames 6*a*, 6*b*. The end of the groove 80 is loosely fit over the projection 9*a* provided at the throat plate 9. The air cylinder pushes the roller 12 against the edge 60 of the frame 6*a*, 6*b*, and the start button (not shown) is pressed.

The control circuit 31 controls the control circuit 16 of the sewing motor 15, and the sewing motor begins to rotate. As the sewing motor 15 rotates, the up-down motion of the needle and the motion of the feed dog 14 begin. The shaft 24 rotates and a pulse train with a predetermined frequency are output. This pulse train is set at the predetermined frequency by the divider 29, and is input to one of the input terminals of the AND-gate 33.

When the start button is pressed, the oscillator 30 begins to feed a pulse train into the AND-gate 32. After the button is initially pressed light projected from the photo sensors 19, 20 is not reflected by the frame 6*a*, so no detecting signal/or the control circuit 31 is seen, and the control signal from the control circuit 31 is "L" for $S_1$ and "H" for $S_2$. When this condition is seen, the pulse train from the oscillator 30 is stopped by the AND-gate 32, and only the pulse train from the divider 29 is fed to the pulse motor circuit 16 via the AND-gate 33 and the OR-gate 34. Thus, the pulse motor 17 starts and the roller 12 rotates. Accordingly, the frames 6*a*, 6*b* are conducted along the straight path being guided by the projection 9*a*, and straight stitch line is begun. The feed dog 14 leads the frames 6*a*, 6*b* with the same speed as the roller 12, so the stitching is evenly conducted.

When the photo sensor 19 for the curve detects the reflective seal 10*a*, the photo sensor 19 outputs an "ON" signal. The control circuit 31 receives this "ON" signal and switching signals $S_1$, $S_2$ are switched "H" for $S_1$ and "L" for $S_2$. Accordingly, the pulse trains from the divider 29 is stopped by the AND-gate 33, and the pulse train from the oscillator 30 inputs to the pulse motor circuit 18 via AND-gate 32 and OR-gate 34.

The period $T_2$ of this pulse follows the equation $$T_2 = T_1 R_2 / R_1,$$

wherein $T_1$ indicates the period of the pulse train from the divider 29, $R_1$ indicates the radius at the curved portion 61*a*, and $R_2$ indicates the radius at the center of the groove 80. Based on this equation, the rotated angle of the stepping motor 17 per one pitch will be $R_1$ $R_2$ times the rotated angle at the straight line portion. Accordingly, the feed pitch at the curved portion 61*a*, 61*b* will be $R_1/R_2$ times that of the straight line portion. If the stitch pitch at the straight line portion is defined as $P_1$, the roller feeding pitch at the curved portion is defined as $P_2$ and the roller feeding pitch at the curved portion in the groove is defined as $P_3$, then the following two relations will govern:

$$P_2 = P_3 \times R_2 / R_1$$

$$P_2 = P_1 \times R_2 / R_1$$

Accordingly $P_1 = P_1$ is derived.

Based on this relation, the stitch pitch $P_3$ at the curved groove portion is the same as the stitch pitch $P_1$ at the straight portion, so the stitching quality is very much improved.

When the control circuit 31 receives the "ON" signal from the photo sensor 19, the variable resistor 21 for the straight line switches to the variable resistor 22 for the curved line in order to control the speed of the sewing machine motor 15.

Both variable resistors 21, 22 are set at the same value. Thus, the speed of the sewing motor is not changed when the roller 12 reaches the curved portion 61a; so the difference in speed between the feed dog 14 and the increased speed of the roller 12 at the curved portion causes the profiled frame to rotate easily.

When the roller 12 reaches the end of the curved portion 61a, the stitch line reaches the end of the curved portion 81 in the groove 80, and the photo sensor 19 detects the reflective seal 10b and outputs a detect signal to the control circuit 31. From this signal the control circuit switches such that $S_1$ set to "L" and $S_2$ to "H". Thereby, the pulse train output from the divider 29 is changed to input to the pulse motor 17 and the stitching at the straight portion continues.

When the stitching reaches the corner 82, and the roller 12 reaches a corner portion 61b, the photo sensor 20 for the corner detects a reflective seal 11a and outputs a signal. Upon receiving this signal, the control circuit 31 switches such that $S_1$ goes to "H" and $S_2$ goes to "L", and the sewing motor 15 stops. Thus the pulse train from the oscillator 30 is made to drive the pulse motor 17. Thereby, the frame 6a, 6b rotates by the roller 12 about the projection 9a on the throat plate 9.

When the photo sensor 20 for the corner detects the reflective seal 11b, the photo sensor 20 outputs a signal to the control circuit 31 such that $S_1$ goes to "L" and $S_2$ goes to "H". Thereby, straight stitching continues. In this embodiment, the speed of the sewing motor 15 is kept constant, and the speed of the pulse motor 17 is changed when stitching at the curved portion. However, in another embodiment variable resistors 21, 22 are adjusted such that the speed of the sewing motor 15 at the curved portion is $R_2/R_1$ times the speed at the straight portion. Here, the speed of the pulse motor 17 is kept constant and the same effect will be attained. In such case, if the speed at the straight portion is set as in the aforementioned embodiment and the speed at the curved portion is lowered the productivity will be decreased although AND-gates 32, 33 and the OR-gate 34 will be eliminated and the control circuit is simplified.

Figure 4:
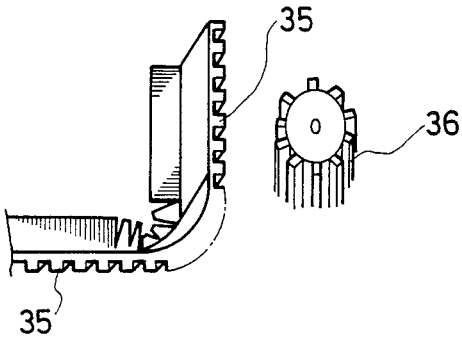
FIG. 4 is a plan view drawing of a frame and a drive pinion according to another embodiment.
Figure 5:
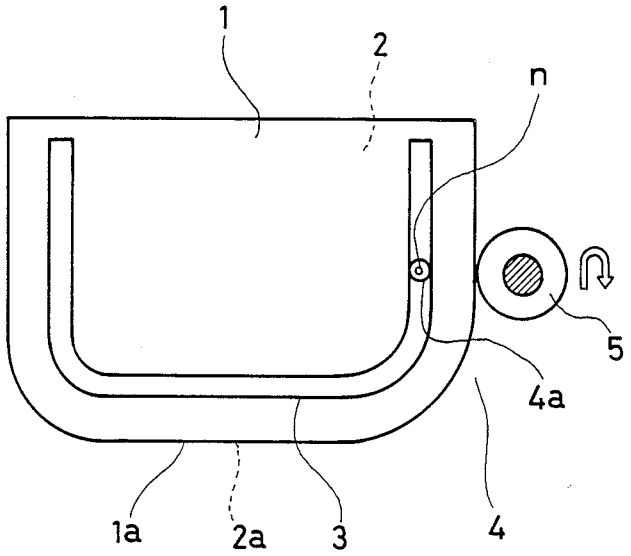
FIG. 5 (PRIOR ART)
FIG. 5 is a plan view drawing of a frame and a drive roller according to a conventional profile stitcher.
Figure 6:
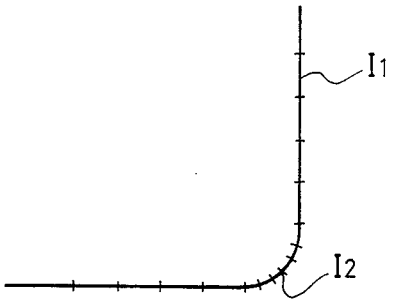
FIG. 6 (PRIOR ART)
FIG. 6 is a plan view drawing of a stitched line according to the prior art.

In the first said embodiment, the roller 12 is pressed against the edge of the frame such that the frame is conducted frictionally. In another embodiment, as shown in FIG. 4, the roller 12 can be substituted by a pinion 36 and the edge of the frame is geared with pinion 35. In this embodiment the frame will be conducted securely and with stronger force.

As many apparently widely different embodiments of the invention may be made without departing from the spirit and scope therein, it is to be understood that this invention is not to be limited to the specific embodiments shown.

What is claimed is:

1. A profile stitcher, comprising:

a throat plate;

a profiled frame for holding workpiece fabrics on said throat plate, said profiled frame having straight and curved edges;

said profiled frame including an inner groove engraved thereon, said groove having straight and curved portions corresponding to respective straight and curved edges of said profiled frame, the curved portions of said groove having a radius of curvature which differs from a radius of curvature of said curved edges corresponding to the curved portions;

a roller for pressing against said edges of said profiled frame;

a non-contact sensor for detecting said curved edges of said profiled frame;

motor means for rotating said roller; and means for applying signals to said motor means such that said roller rotates at a speed which is faster than a workpiece fabric feeding speed when said noncontact sensor detects said curved edges of said profiled frame, and at a speed equal to said workpiece fabric feeding speed when said non-contact sensor does not detect said curved edges of said profiled frame, wherein said motor means is a pulse motor and wherein said signals applying means includes:

a first pulse generator responsive to a speed of a main motor of a sewing machine, for generating a pulse signal causing said pulse motor to rotate said roller at a first speed equal to the workpiece fabric feeding speed;

a second pulse generator for generating a second pulse signal causing said pulse motor to rotate said roller at a second speed proportional to said first speed according to a value of the radius of curvature of said curved edge divided by the radius of curvature of said curved portion;

control means for selectively applying said first and second pulse signals to said pulse motor such that said second pulse signal is applied when said noncontact sensor detects said curved edge, and said first pulse signal is applied when said non-contact sensor does not detect said curved edge.

* * * * *